United States Patent [19]

Reed

[11] Patent Number: 4,703,929

[45] Date of Patent: Nov. 3, 1987

[54] INVERSION MACHINE

[76] Inventor: Frank G. Reed, Okawa Bay Road, Mourea, Rotorua, New Zealand

[21] Appl. No.: 844,783

[22] Filed: Mar. 27, 1986

[30] Foreign Application Priority Data

Mar. 27, 1985 [NZ] New Zealand ..... 211590

[51] Int. Cl.[4] ..... A63B 23/04

[52] U.S. Cl. ..... 272/144; 128/71; 128/75

[58] Field of Search ..... 272/144, 145; 128/68, 128/71, 75

[56] References Cited

U.S. PATENT DOCUMENTS

| | | | |
|---|---|---|---|
| 1,693,810 | 12/1928 | Daniels et al. | 272/144 X |
| 3,685,511 | 8/1972 | Alvarez | 272/145 X |
| 4,292,962 | 10/1981 | Krause | 272/145 X |
| 4,461,287 | 7/1984 | Takahashi | 272/145 X |
| 4,503,845 | 3/1985 | Licciardi | 272/145 X |
| 4,566,693 | 1/1986 | Seidentop et al. | 272/144 |
| 4,609,193 | 9/1986 | Paris et al. | 272/145 |

*Primary Examiner*—Richard J. Apley
*Assistant Examiner*—J. Welsh
*Attorney, Agent, or Firm*—Young & Thompson

[57] ABSTRACT

This invention relates to an exercising apparatus which facilitates inversion of the user for exercise.

The apparatus includes a frame portion which is adjustable in height and a first rest portion which is substantially horizontally pivotable for resting against a user's thighs and pelvis. A second rest portion is provided to be pivotable relative to the first rest portion between a lower rest position and an upper use position, the second rest portion being mounted on a linkage which facilitates a downwardly depending rest position whereby the second rest portion is spaced from said first rest portion to enable a user to step into the apparatus and to in use to move to the rest position whereby it is positioned above and to one side of the first rest position with a user's thigh thereunder.

5 Claims, 6 Drawing Figures

INVERSION MACHINE

This invention relates to an exercising apparatus and more particularly to an exercising apparatus which enables a person to support himself in a variety of positions for rest including an inverted or substantially inverted position.

Hitherto, exercising apparatus have been provided which enable a person to support himself in the inverted position, such exercise apparatus including a frame which rests upon a supportive surface and mounts a first padded rest which is pivotable about a substantially horizontal axis. The frame mounts a second padded rest which in use is supported in a normally fixed relationship with the first rest, higher than, but not usually directly above the first rest, when inverted on the apparatus a user's thighs and lower abdomen are received and rest against the first rest and the user's rear upper leg are received under the second rest to stabilise the user on the apparatus.

Prior art exercising apparatus of the type described incorporates certain inherent disadvantages. A prime disadvantage is the difficulty that a user finds in positioning himself in the apparatus prior to inversion and use, further, the difficulty in disengaging himself from the apparatus after use. Prior art units also create problems in that the first and second rests must be adjusted in position relative to one another to suit the various sizes of users prior to use and thus, where the exercise apparatus is used, for example, in a family for example by adults of differing sizes, (or children of differing sizes), it is necessary for the apparatus to be adjusted before each usage.

Prior art units have provided means for adjusting the normally fixed relationship of the first rest and second rest relative to each other prior to usage however, such adjustment means requires time and skill to adjust quickly and further, leads to complication and therefore expense in the completed unit.

It is an object of this invention to come some way in overcoming the abovementioned problems or at least provide the public with a useful choice.

Other objects of this invention will become apparent from the following description.

According to one aspect of this invention, there is provided an exercising apparatus including a frame, said frame pivotally mounting a first support adjacent an upper portion of said frame, a second support pivotally mounted to said frame via a linkage which enables the second suport to move between a position below a level of said first support to a position above said level and to one side of said first support.

Wherein the first support is pivotable according to a substantially horizontal axis.

Wherein said first support is pivotable on a horizontal axis which is substantially aligned with a use upper surface of said first support.

Wherein at least one edge of said first support portion is shaped to fit lower pelvic and/or thigh portions of a person's body.

Wherein said second support is pivotable on a substantially horizontal axis spaced form the pivot axis of said first support.

Wherein the second support pivot axis is positioned spaced below and to one side of said pivot axis of said first support.

Wherein the second suport is pivotable on a link which extends radially from the pivot mounting of said second support.

Wherein the radius of pivot of said second support is adjustable.

Wherein the pivotable mounting of said second support is adjustable relative to said second support.

Wherein the link includes a plurality of engagement positions for a pivot axle of said second support.

Wherein the frame is in the form of an A frame including two U shaped portions pivotally engaged with one another adjacent their upper ends, the first support and engaged upper ends of the U shaped portions engaged via a common pivot axle.

Wherein the second support is mounted via the linkages from one of the U shaped portions of the frame and wherein said second support pivots between legs of the U of said frame portion.

Other aspects of this invention which should be considered in all its novel aspects will become apparent from the following description which is given by way of example with reference to the accompanying drawings.

Figure 3A:
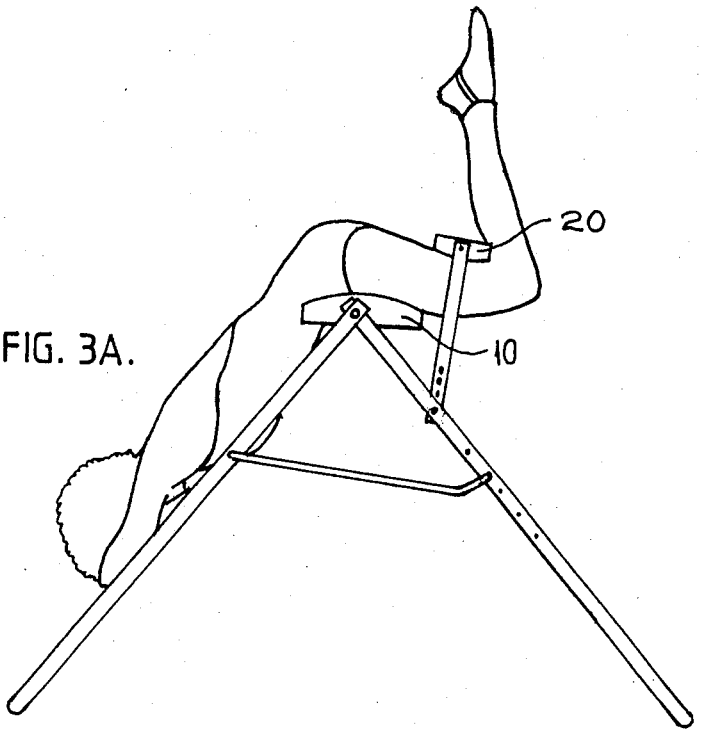

FIGS. 3A and B show the apparatus of this invention used in typical exercising modes.

Figure 1:
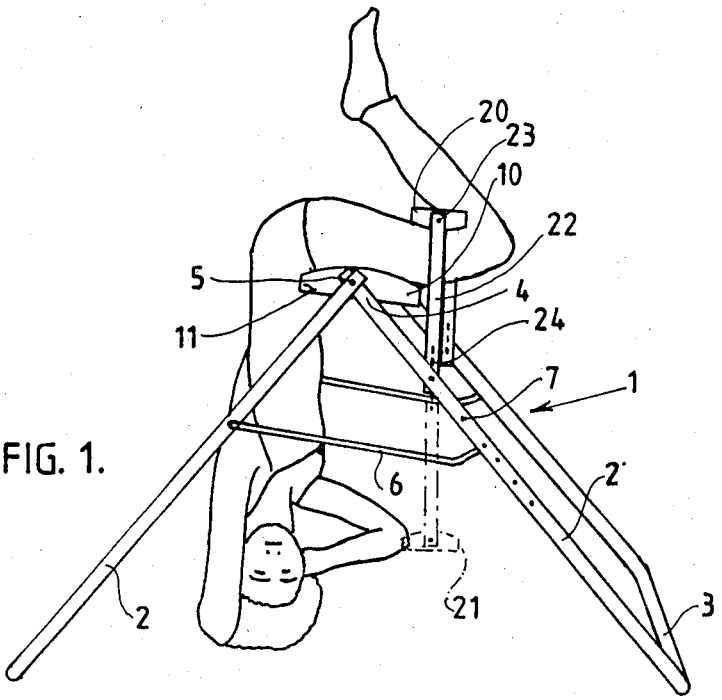
FIG. 1 is a substantially diagrammatic side view of the invention in a use position and showing a person exercising in the apparatus according to this invention.

Turning particularly to FIG. 1, the apparatus of this invention is formed in any suitabe durable and robust materials such as wood, metal and the like. In the preferred form of the invention preferably the apparatus includes a frame as generally indicated by arrow 1 which in the preferred form is provided as a pair of U shapes portions 2 or "legs" having their bases 3 provided to rest upon a supporting surface and their upper ends 4 being preferably conjoined via an axle 5 (such as a bolt).

In the preferred form of the invention, preferably the U shaped portions of the frame 1 are provided to be of slightly different size so that on portion 2 can collapse inside the other for storage.

Preferably a stay 6 is provided on each side in the form of an elongate rod having one end thereof securely engaged with an aperture (not shown) in the leg and the other end portion substantially hooked or otherwise engageable in a plurality of apertures 7 spaced along a mid portion of the leg 2 so as to enable engagement of the rod 6 with legs 2 to provide a variety of frame angles to vary the height of the frame.

In this preferred form of the invention, the axle 5 of the apparatus mounts a first pad 10 thereon. The first pad 10 or body pad is preferably positioned between the end portions 4 and is pivotally mounted according to a substantially horizontal axis provided by said axle 5. Preferably at least an upper surface of the first pad 10 is padded. The upper surface of the rest portion 10 is so arranged as to align (when depressed with the weight of a user) close to the axis of the axle 5. It will thus be appreciated that the first pad 10 is pivotally mounted on the frame portion 1 and is able to rotate substantially according to the substantially horizontal axis provided.

Preferably at least one edge portion 11 of the first pad 10 is substantially curved or arcuate so as to accommodate the shape of a person's body when resting there-against. However, it is to be appreciated that this is in no way essential to the invention.

A second rest pad as generally indicated by arrow 20 is provided to be pivotable relative to the remaining portions of the apparatus from a rest position as shown by broken lines 21 to a use position as depicted by the solid lines.

In this preferred form of the invention, the second pad 20 is preferably provided as a substantially small transverse padded element mounted to a link 22, the link in this preferred form of the invention including a pair of spaced apart bar members which have outer end portions 23 engaged with or mounting the second pad 20 thereon and having inner ends 24 thereof pivotally engaged on aligned pivotal axes with upper mid portions of one of the U shaped leg portions 2.

In the preferred form of the invention, preferably the second pad 20 is mounted on a framework which includes a substantially U shaped portion, legs of the U shape providing the links 22, the base of the U shape providing a reinforcement for mounting the second pad 20 thereon.

In the preferred form of the invention, the link 22 and pad 20 is pivotable between adjacent leg portions 2 of the U shaped frame portion 1 to which it is mounted.

From the drawing, it will be seen that the second pad 20 is pivotable from the rest position 21 (where the second pad 20 is positioned substantially below a level of the first pad 10 and to one side), to a position in use where it is positioned substantially above and to one side of the first pad 10.

Preferably adjustment means is provided for facilitating adjustment of at least the use position, and particularly the height of the second pad 20 relative to the first pad 10 when in use. The adjustment is in the preferred form of the invention provided by means of a plurality of apertures in the inner end 24 of the link 22 or alternatively, a number of apertures in the relevant portion of the legs 2 to thus enable the pivotal engagement of the links 22 with the frame 1 to be varied and thus vary the height of the second pad 20.

Use of the apparatus will now be described with reference to FIGS. 2A, 2B and 2C and FIGS. 3A and 3B.

Figure 2A:
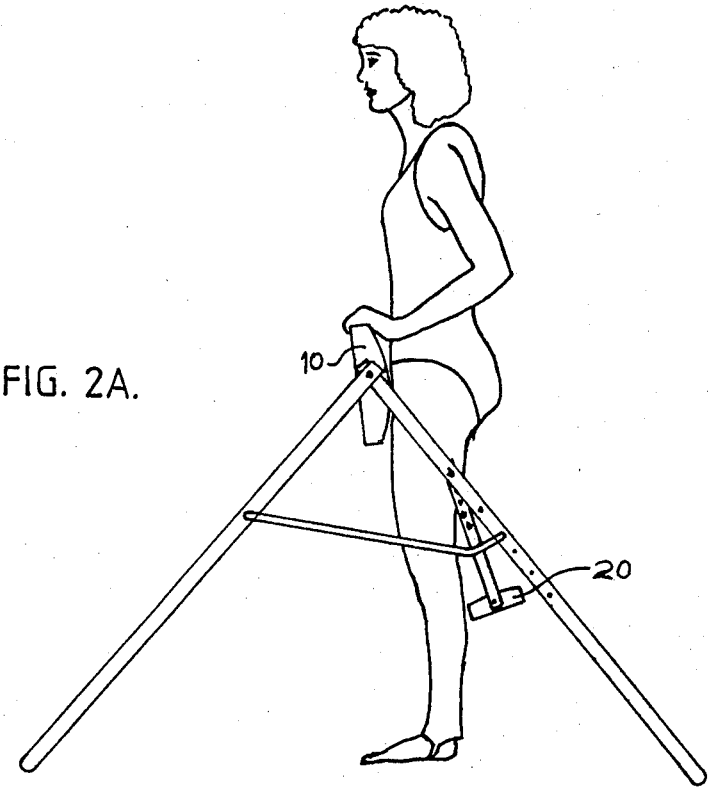
FIG. 2 shows a series of views showing a person entering the apparatus of this invention under sub-views 2A, 2B and 2C.
Figure 2B:
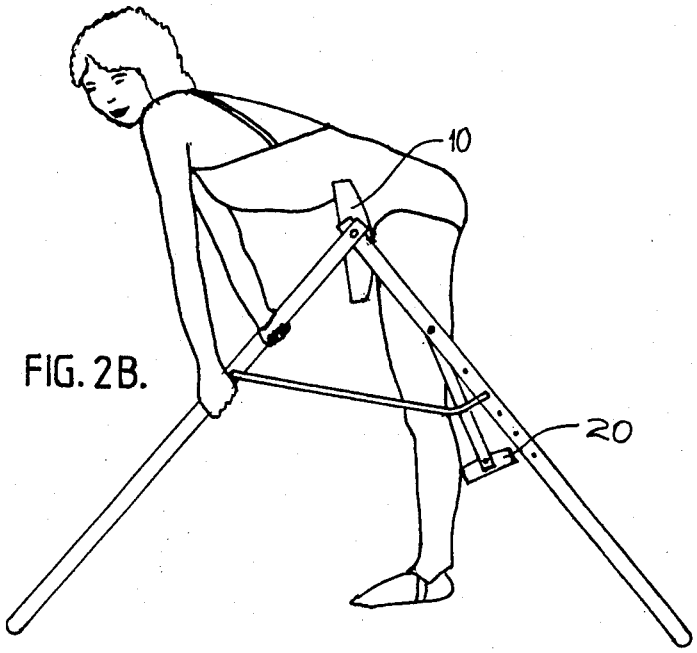
Figure 2C:
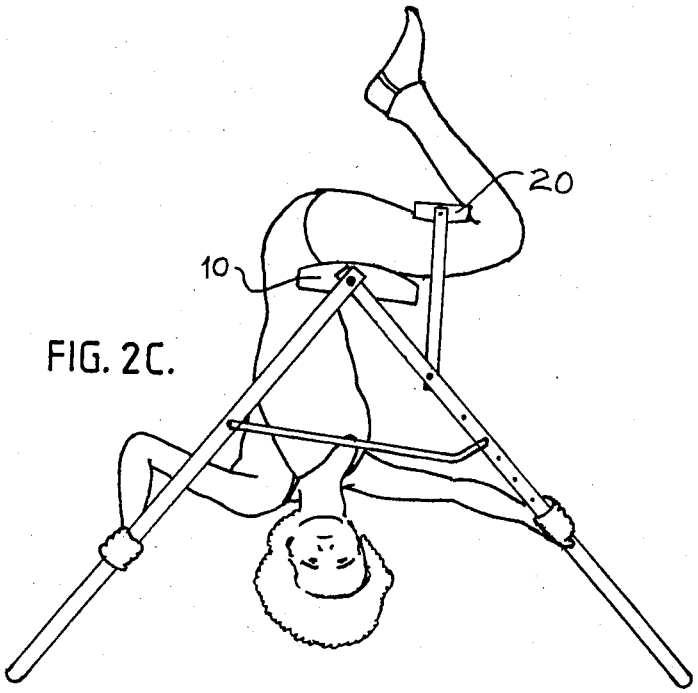
Figure 3B:
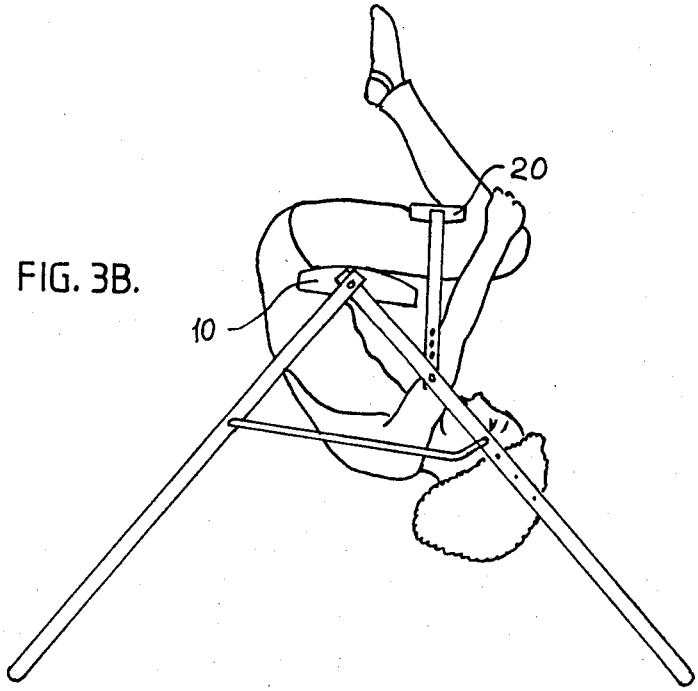

Referring to FIGS. 2A, B and C, firstly, the frame 1 is adjusted so that the axle 5 is positioned substantially on or adjacent the line of the lower pelvic area of the intended user. Thereafter, whilst the second pad 20 is in or adjacent the rest position, the user steps into the apparatus and positions the upper thighs and lower pelvis adjacent the upper surface of the first pad 10 which pivots to lie adjacent the user's body. Further, the second pad 20 is arranged to rest against the rear of the user's legs. The user then leans forwardly into a position substantially as shown by FIG. 2B and beyond, rolling forwardly; the first rest portion 10 tilts with the user's body and the second rest portion pivots upwardly into a position as shown by FIG. 2C as the user inverts on the apparatus until the links 22 adopt a substantially upright position. A binding action between the first pad 10 and second pad 20 impinges against the thighs of the user and rear leg of the user and accordingly ceases further rotational movement of the user. Once in position, the user can then carry out various exercises such as those as shown by FIGS. 3A and 3B. Various positions can be adopted and maintained for exercise purposes.

It will be appreciated that owing to the substantially pivotal nature of the second pad 20 from its lower rest position to the use position, it is substantially easy for the user to position in the apparatus prior to inversion. Furthermore, the first and second pads 10 and 20 reach their use relationship substantially automatically upon the user inverting on the apparatus.

In view of the lack of a defined positional relationship between the first and second pads 10 and 20, there is a tendency for the apparatus to advantageously accommodate variations in users dimensions (such as, thickness and length of thigh or upper leg) which hitherto has not been found in such exercising apparatus.

Dismounting from the apparatus is achieved by merely reversing the entry sequence described.

Thus by this arrangement there is provided an apparatus for inversion exercising.

I claim:

1. An inversion exercise device comprising a frame, a first support pivotably mounted about a horizontal axis adjacent the top of said frame for supporting the thighs of a user, a second support for engaging the back of the user's legs pivotably mounted to a link, said link being pivotably mounted to said frame below and on one side of said horizontal axis, wherein said link rotates about a horizontal axis spaced from the horizontal axis of said first support, such that the second support moves from a position below the first support when not in use and to a position above said first support when in use.

2. Apparatus as claimed in claim 1, and means for adjusting the distance between said second support and the horizontal axis about which said link rotates.

3. Appartus as claimed in claim 1, and means for adjusting the distance between said horizontal axes.

4. Apparatus as claim in claim 1, in which said first support has a thigh-contacting surface substantially aligned with said horizontal axis about which said first support pivots.

5. An inversion exercise device comprising a generally A-shaped frame, a first support pivotably mounted about a horizontal axis adjacent the apex of said frame for supporting the thighs of a user, a second support for engaging the back of the user's legs pivotably mounted to a link, said link being pivotably mounted to said frame below and on one side of said apex, wherein said link rotates about a horizontal axis spaced from the horizontal axis of said first support, such that the second support moves from a position below the first support when not in use and to a position above said first support when in use.

* * * * *